US005677589A

United States Patent [19]

Westemeyer

[11] Patent Number: 5,677,589

[45] Date of Patent: Oct. 14, 1997

[54] CAPPED HIGH-PRESSURE DISCHARGE LAMP

[75] Inventor: Manfred Westemeyer, Aldenhoven, Germany

[73] Assignee: U.S. Philips Corporation, New York, N.Y.

[21] Appl. No.: 442,553

[22] Filed: May 16, 1995

[30] Foreign Application Priority Data

May 19, 1994 [EP] European Pat. Off. ..... 94201416

[51] Int. Cl.[6] ..... H01J 5/50; H01J 61/36

[52] U.S. Cl. ..... 313/25; 313/17; 313/318.07; 313/318.09; 313/318.1

[58] Field of Search ..... 313/25, 17, 318.07, 313/318.09, 318.1, 26

[56] References Cited

U.S. PATENT DOCUMENTS 4,763,038 8/1988 Takayama ..... 313/318.07
5,440,199 8/1995 Heindl et al. ..... 313/318.07

FOREIGN PATENT DOCUMENTS 0321866 6/1989 European Pat. Off. ..... H01J 5/56
3743612 7/1989 Germany .

*Primary Examiner*—Nimeshkumar Patel
*Attorney, Agent, or Firm*—Walter M. Egbert

[57] ABSTRACT

The capped high-pressure discharge lamp has a discharge vessel having opposite neck-shaped portions. A tubular glass sleeve envelopes the discharge vessel and has constrictions coupling the sleeve to a respective neck-shaped portion. The sleeve has an end-portion adjacent a constriction at the side thereof which is remote from the other constriction, in which end portion a pinch is present. A clamping member having lugs which hold the pinch is secured to a mounting member which is fixed to a cap. The pinch provides for a mechanically strong portion to secure the discharge vessel to the cap. The construction is able to withstand heavy shocks which may occur during transport.

5 Claims, 1 Drawing Sheet

CAPPED HIGH-PRESSURE DISCHARGE LAMP

BACKGROUND OF THE INVENTION

The invention relates to a capped high-pressure discharge lamp comprising:

- a glass discharge vessel with mutually opposed neck-shaped portions each having a seal, in which discharge vessel an ionizable filling and electrodes are present;
- a glass, tubular outer envelope around the discharge vessel, which envelope has a first and a second constriction where the envelope is coupled to a respective neck-shaped portion;
- a metal clamping member fixedly connected to the discharge vessel;
- a lamp cap of insulating material with contacts which are electrically connected each to a respective electrode;
- a metal fixation member fixedly connected to the lamp cap and fastened to the clamping member.

Such a capped high-pressure discharge lamp is known from EP 0 570 068-A. The lamp may be used as a headlight lamp in vehicles.

In the known lamp, the neck-shaped portion situated near the first constriction projects beyond the outer envelope. The clamping member is a metal sleeve which grips around said neck-shaped portion and is closed with welds.

The outer lamp envelope is useful for reducing temperature differences of the lamp vessel during operation. The luminous flux of the lamp can be increased by minor temperature differences while the consumed power remains the same. An increase in the luminous flux can even be realised at a maximum lamp vessel temperature which corresponds to the maximum temperature in the absence of the envelope. It is also possible to realise a reduction in the maximum temperature while the same luminous flux is achieved as that given by a non-enveloped lamp. The luminous flux and the maximum temperature are dependent on the value of the clearance between the outer envelope and the lamp vessel. It is also possible to utilize the outer envelope, for example, for providing a filter around the discharge vessel, for example a UV filter.

The outer envelope causes an increase in the mass which is coupled to the lamp cap. Nevertheless, the coupling between the discharge vessel and the lamp cap is sufficiently strong for the operational application of the lamp. It was found, however, that the lamp may be subject to such strong impacts during transport that the neck-shaped portion breaks near the constriction, as a result of which the electrodes lose an accurately adjusted position relative to the lamp cap.

SUMMARY OF THE INVENTION

It is an object of the invention to provide a capped high-pressure discharge lamp of the kind described in the opening paragraph which is of a simple construction and which has an improved mechanical strength.

According to the invention, this object is achieved in that the outer envelope has an end portion adjoining the first constriction at the side thereof facing away from the second constriction, which end portion has a pinch, and in that the clamping member is a bush provided with a bottom with an opening alongside which mutually opposed tags are arranged which hold said pinch.

The pinch has a comparatively great dimension and strength owing to the increased diameter which the outer envelope must have in order to surround the discharge vessel. As a result, the pinch offers a sturdy, comparatively wide area of contact for the clamping member, i.e. the bush. Since the clamping member grips the outer envelope, said envelope has been given a support function for the discharge vessel, which it supports with its constrictions in two locations removed from one another.

The use of the clamping bush has the advantage that the joining together of this bush and the enveloped discharge vessel suffices for achieving a secure connection between these two. Welding operations necessary for fixing a metal sleeve around a neck-shaped portion can thus be omitted.

It is noted that in general quartz glass, or at least glass with an $SiO_2$ content of at least 96% by weight, will be used for the discharge vessel and the outer envelope. Electrical conductors made of, for example, molybdenum can extend through respective seals of the discharge vessel to the lamp cap. One of these conductors will then be present in the pinch. In general, the pinch will not enclose the conductor, when the latter has a wire shape, in a vacuumtight manner owing to the difference in coefficient of thermal expansion between the glass and the conductor. The pinch is highly suitable, however, for enveloping the relevant conductor over a longitudinal portion thereof, for example up to inside the lamp cap, and thus screening it off from the other conductor, so that no flash-over between the two can occur.

It is favourable for achieving an extra secure grip of the clamping member on the pinch when the pinch has a profile, for example projections, with which tags of the clamping member cooperate.

It was found that the capped high-pressure discharge lamp according to the invention, though of a simple, easily manufactured construction, has a high resistance to shocks and impacts.

BRIEF DESCRIPTION OF THE DRAWINGS

An embodiment of the capped high-pressure discharge lamp is shown in the drawing, in which.

DESCRIPTION OF THE PREFERRED EMBODIMENTS

Figure 1:
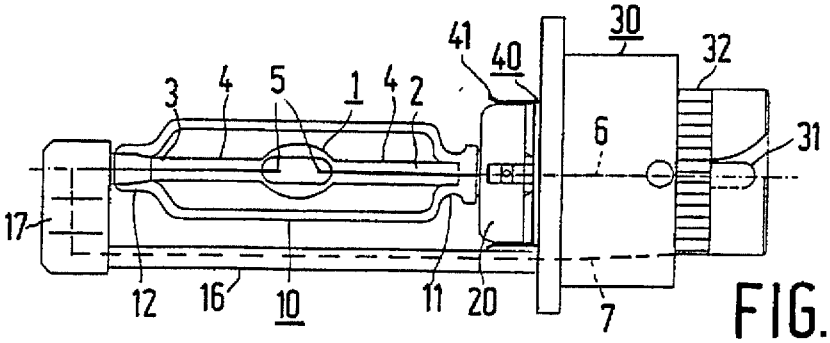
FIG. 1 shows a capped high-pressure discharge lamp in side elevation.

In FIG. 1, the capped high-pressure discharge lamp has a glass discharge vessel 1, made of quartz glass in the Figure, with mutually opposed neck-shaped portions 2, 3, in each of which a seal 4 is present. The discharge vessel has an ionizable filling, for example of mercury, rare gas, and metal halides, as well as electrodes 5. A glass tubular outer envelope 10, made of quartz glass in the Figure, surrounds the discharge vessel 1. The envelope has a first 11 and a second constriction 12, at which locations the envelope is coupled to respective neck-shaped portions 2, 3, for example by fusion. A metal clamping member 20 is fixedly connected to the discharge vessel 1. A lamp cap 30 of insulating material, for example of synthetic resin, for example of polyether imide, possibly filled with glass powder or glass fibres, has contacts 31, 32 which are electrically connected each to a respective electrode 5. A metal fixation member 40 is fixedly connected to the lamp cap 30 and is fastened to the clamping member 20, so that the discharge vessel is rigidly connected to the lamp cap. The outer envelope 10 has an end portion 13 adjoining the first constriction 11 at the side thereof facing away from the second constriction 12, in which end portion a pinch 14 is present. The clamping member 20 is a bush provided with a bottom 21 with an opening 22 alongside which mutually opposed tags 23 are arranged, which hold the pinch 14.

The fixation member 40 in the Figure is a cylindrical body which carries tongues 41 on which welded connections with the clamping member 20 were made after the electrodes 5 had been aligned relative to the lamp cap 30. The fixation member may have been fixed in the lamp cap, for example, by ultrasonic heating. It is favourable, however, when the fixation member is enclosed by clamping in the lamp cap. The fixation member may have, for example, scraping tags for this purpose.

The lamp cap 30 is shown broken-away in FIG. 1. The conductor 6, which is connected to one of the electrodes is fastened to the contact 31. The conductor 7, which extends from the contact 32 to the other electrode, is enveloped by a ceramic pipe 16 and a ceramic cap 17 in order to prevent that live lamp parts can be touched when a connector is applied on the lamp cap.

Figure 2:
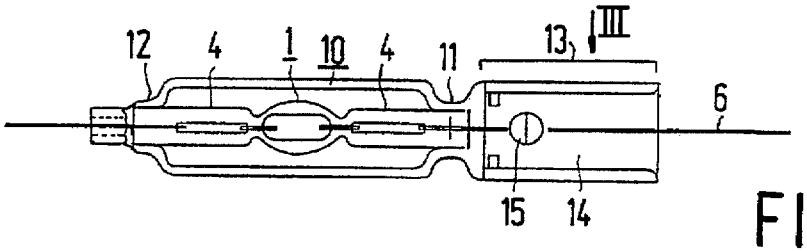
FIG. 2 shows the discharge vessel with its outer envelope of FIG. 1.
Figure 3:
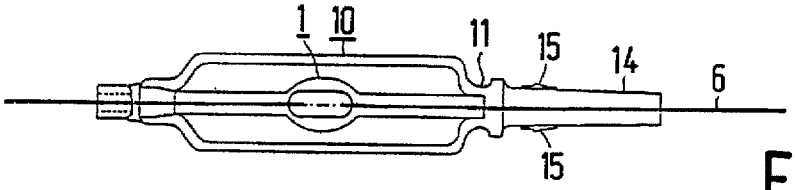
FIG. 3 shows the component of FIG. 2 taken on III in FIG. 2.
Figure 4:
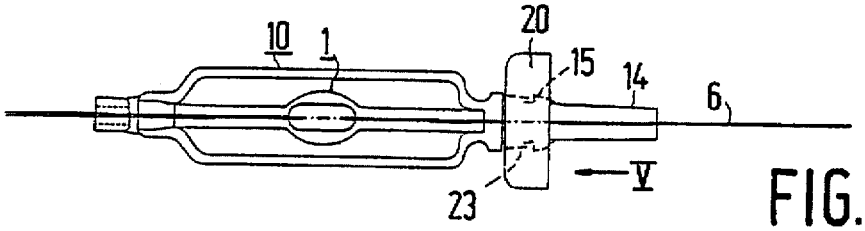
FIG. 4 shows the component of FIG. 2 with a clamping member mounted thereto.
Figure 5:
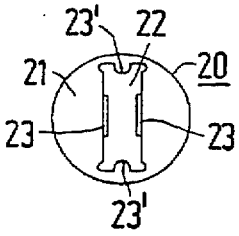
FIG. 5 shows the damping member of FIG. 4 taken on V.

FIGS. 2 and 3 show the glass portions of the lamp after a pinch has been made in the end portion 13 of the outer envelope. Since the molybdenum wire 6 in said pinch has contracted more strongly than the pinch glass after the manufacture of the pinch, this wire will lie loose in the pinch and the pinch is not vacuumtight. This is in contrast to the seals 4 of the discharge vessel 1, in which foils are embedded in order to obtain vacuumtightness.

In the Figures, the pinch 14 adjoins the constriction 11. The pinch has a profile 15, behind which the tags 23 of the bush 20 grip, on its two wider surfaces. The bush 20 also has minor tags 23' which cooperate with the narrower surfaces of the pinch 14.

I claim:

1. A capped high-pressure discharge lamp comprising:

a glass discharge vessel with mutually opposed neck-shaped portions each having a seal, in which discharge vessel an ionizable filling and electrodes are present;

a glass, tubular outer envelope around the discharge vessel, which envelope has a first and a second constriction where the envelope is coupled to the respective neck-shaped portions of the discharge vessel;

a clamping member fixedly connected to a portion of the outer envelope;

a lamp cap of insulating material with contacts which are electrically connected to each respective electrode;

a metal fixation member fixedly connected to the lamp cap and fastened to the clamping member, characterized in that: the outer envelope has an end portion adjoining the first constriction at the side thereof facing away from the second constriction, which end portion has a pinch, and in that the clamping member is a bush provided with a bottom with an opening alongside which mutually opposed tags are arranged, which hold said pinch.

2. A capped high-pressure discharge lamp as claimed in claim 1, wherein the pinch has a profile with which tags of the clamping member cooperate.

3. A capped high-pressure discharge lamp as claimed in claim 1, wherein the outer envelope is quartz.

4. A capped high-pressure discharge lamp as claimed in claim 1, wherein the clamping member is metal.

5. A capped high-pressure discharge lamp comprising:

a glass discharge vessel with mutually opposed neck-shaped portions each having a seal, the discharge vessel having an ionizable filling and electrodes extending from the respective neck-shaped portions;

a quartz glass envelope surrounding the discharge vessel, the envelope having a first and a second constriction coupled to the respective neck-shaped portions of the discharge vessel, and an end portion surrounding one of the electrodes and adjoining the first constriction at the side thereof facing away from the second constriction, the end portion having a pinch;

a clamping bush provided with a bottom with an opening alongside which mutually opposed tags are arranged, which tags fixedly hold said end portion adjacent said pinch, said clamping bush positioned on said pinch such that a longitudinal portion of the end portion surrounding the electrode extends beyond said clamping bush;

a lamp cap of insulating material having contacts which are electrically connected to each respective electrode; and a metal fixation member fixedly connected to the lamp cap and fastened to the clamping member.

* * * * *